US006666358B1

(12) United States Patent
Field

(10) Patent No.: US 6,666,358 B1
(45) Date of Patent: Dec. 23, 2003

(54) BEER CONTAINER

(75) Inventor: Warwick William Field, Kalorama (AU)

(73) Assignee: Ecokeg Pty Ltd, Glen Iris (AU)

( * ) Notice: Subject to any disclaimer, the term of this patent is extended or adjusted under 35 U.S.C. 154(b) by 0 days.

(21) Appl. No.: 10/018,397

(22) PCT Filed: Jun. 19, 2000

(86) PCT No.: PCT/AU00/00687

§ 371 (c)(1),
(2), (4) Date: May 24, 2002

(87) PCT Pub. No.: WO00/78665

PCT Pub. Date: Dec. 28, 2000

(30) Foreign Application Priority Data

Jun. 18, 1999 (AU) ..... PQ1050

(51) Int. Cl.[7] ..... B65D 83/00
(52) U.S. Cl. ..... 222/400.7
(58) Field of Search ..... 228/183, 399, 228/400.7

(56) References Cited

U.S. PATENT DOCUMENTS 3,563,423 A * 2/1971 Wilson ..... 222/396
3,908,871 A * 9/1975 Gottwald ..... 222/400.7
4,032,047 A * 6/1977 Wilson ..... 222/163
4,678,101 A * 7/1987 Nitchman et al. ..... 222/82
4,739,901 A 4/1988 Dorfman et al. ..... 222/1
5,636,766 A * 6/1997 Delameter et al. ..... 222/183
6,073,811 A * 6/2000 Costea ..... 222/183

FOREIGN PATENT DOCUMENTS

DE 3725563 A 2/1989
DE 3908099 A1 9/1990
GB 2203117 10/1988

OTHER PUBLICATIONS

International Search Report, International Application No. PCT/AU00/00687, International Filing date Jun. 19, 2000.
PCT International Published Application No. PCT/US95/01545, Published as WO 95/26997, Publication date Oct. 12, 1995.

* cited by examiner

*Primary Examiner*—Joseph A. Kaufman
(74) *Attorney, Agent, or Firm*—Van Dyke, Gardner, Linn & Burkhart, LLP

(57) ABSTRACT

A beer container comprises an inner hollow shell of blow moulded PET to hold beer, an outer hollow shell of moulded high density polyethylene enclosing and supporting the inner shell and a spear structure including a dispenser tube extending from a bottom interior region of the inner shell through to a dispensing outlet at the top of the outer shell. The spear structure incorporates valves for supply of pressurizing gas into the interior of inner shell and for dispensing beer through the dispensing outlet, both valves being formed of PET. When the container has been emptied of beer, the outer shell can readily be separated from the inner shell and spear structure to allow separate recycling of the high density polyethylene material and the PET material.

14 Claims, 2 Drawing Sheets

BEER CONTAINER

TECHNICAL FIELD

This invention relates to beer containers and particularly to containers for rapidly dispensing beer in commercial establishments or at sporting and social events.

BACKGROUND OF THE INVENTION

Beer is presently supplied to commercial establishments or for special events in stainless steel kegs. These are of sturdy welded stainless steel construction and are fitted with a dispensing spear structure comprising a long stainless steel dispenser tube through which to dispense beer from the bottom of the keg and a pressurising valve through which to supply pressurising $CO_2$ gas into the keg so as to pressurise the contents and force the beer out through the dispensing tube when a dispensing valve is operated.

Stainless steel beer kegs are very expensive to produce and they are designed to be returned to the brewery for cleaning and refilling. They will typically be the property of the brewery which may accordingly need to have large sums of capital committed to maintaining appropriate stocks of kegs. Large sums can be lost if kegs are not returned. This problem could be largely overcome if it were possible to supply beer in bulk in low cost disposable dispensing containers, but no satisfactory containers for this purpose have hitherto been available.

Plastics technology has been applied to the manufacture of disposable beverage containers in small sizes, such as soft drink and beer bottles. These have generally been blow moulded in PET (polyethylene terephthalate), but it has not been possible to apply this technology to the production of larger size dispensing containers because of the barrier properties of PET in large size containers and the problem of producing a construction which allows effective recycling of all of the materials required for the dispensing components of a workable container. The present invention overcomes these problems by providing a multi-component container in which all components may be fully recyclable.

DISCLOSURE OF THE INVENTION

According to the invention, there is provided a beer container comprising:

- an inner hollow shell of blow moulded PET to hold beer;
- an outer hollow shell of moulded high density polyethylene closing and supporting the inner shell; and
- a spear structure including a dispenser tube extending from a bottom interior region of the inner shell through to a dispensing outlet at the top of the outer shell.

Preferably, the spear structure in fixed to the inner shell and is constructed of PET.

The spear structure may incorporate a valve for supply of pressurising $CO_2$ gas into the interior of the inner shell and a beer dispenser valve At the dispensing outlet, both valves being moulded in PET.

Preferably, the outer shell is formed in separable pieces which can be separated from the inner shell for recycling of the high density polyethylene of the outer shell separately from the PET material of the inner shell and the spear.

The outer shell may, for example, be comprised of a generally open topped tub-shaped body fitted with a releasable lid. The lid may be a snap fit on the tub shaped body.

Preferably, the inner shell is a sliding fit within the tub shaped main body of the outer shell, whereby it can be slid from the outer shell main body when the lid is removed.

The peripheral wall of the outer shell may be formed with a series of circumferentially spaced, inwardly projecting ribs to engage the inner shell at circumferentially spaced locations to provide the sliding fit of the inner shell within the outer shell.

Alternatively, the outer shell may have a plain cylindrical peripheral surface within which the outer shell is a neat sliding fit.

BRIEF DESCRIPTION OF THE DRAWINGS

In order that the invention may be more fully explained, one particular embodiment will be described with reference to the accompanying drawings, in which.

DETAILED DESCRIPTION OF THE PREFERRED EMBODIMENT

Figure 1:
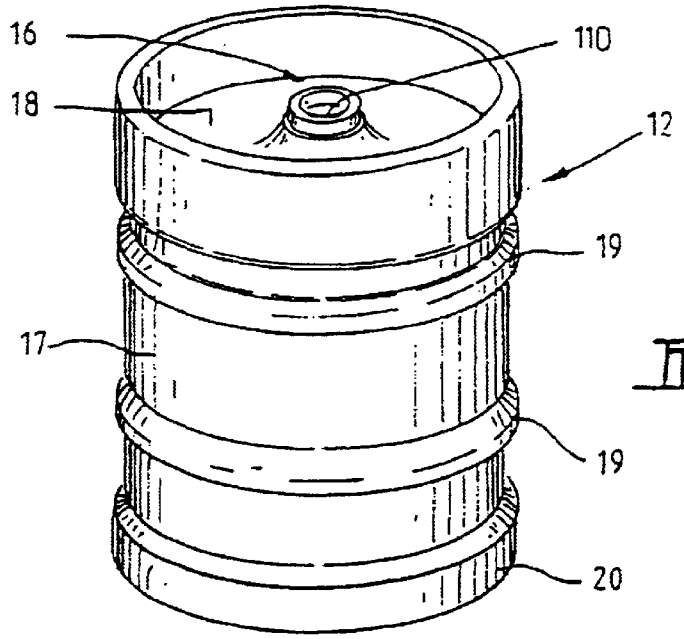
FIG. 1 is a perspective view of a beer keg constructed in accordance with the invention.
Figure 3:
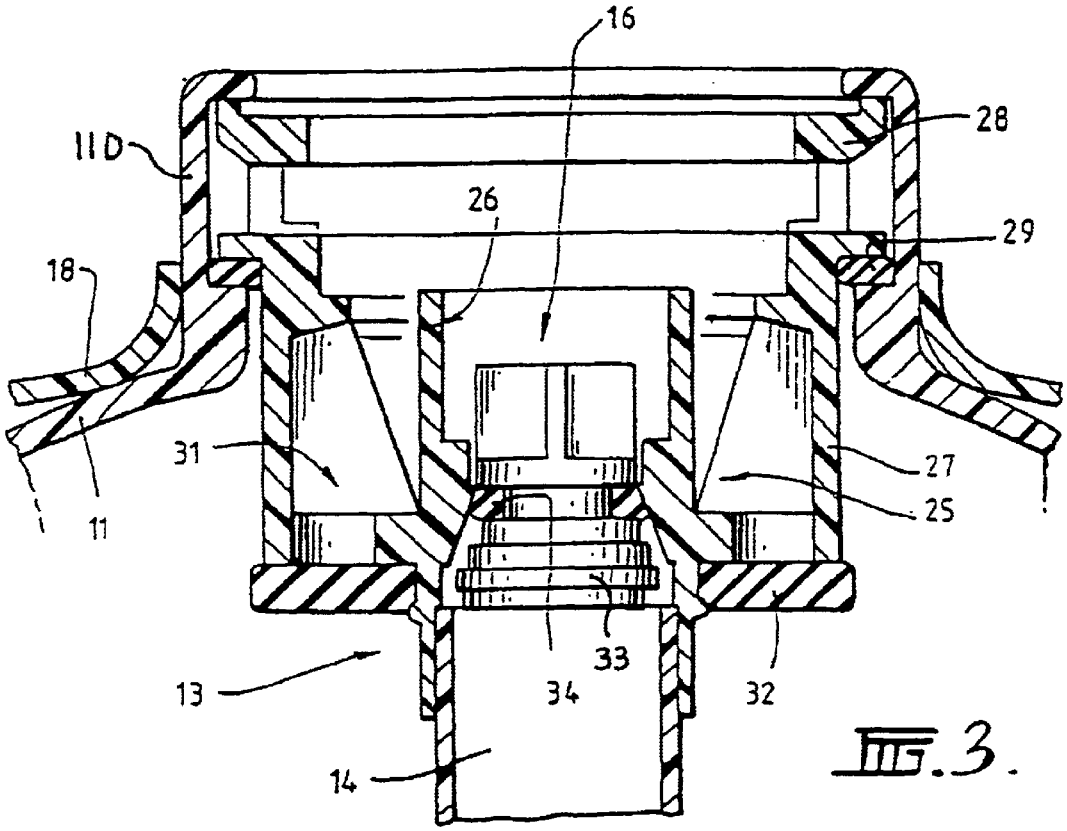
FIG. 3 is an enlarged detail of an upper part of a spear structure installed in the keg.
Figure 2:
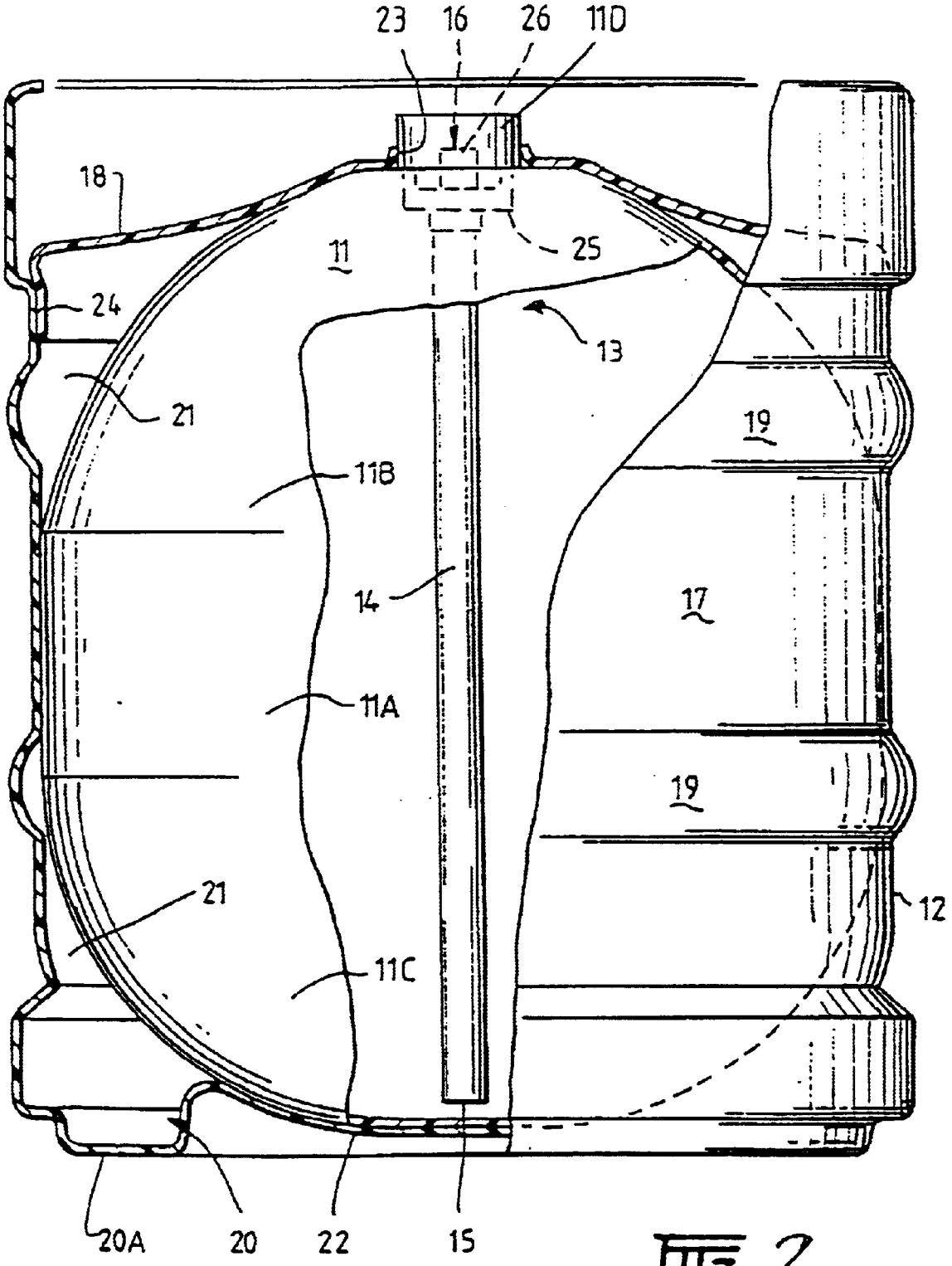
FIG. 2 is a vertical cross section through the beer keg of FIG. 1.

The illustrated beer keg comprises an inner hollow shell 11, an outer hollow shell 12 enclosing and supporting the inner shell, and a spear structure denoted generally as 13. Spear structure 13 comprises a dispenser tube 14 extending from an inlet opening 15 near the bottom of the inner shell 11 to a dispensing outlet 16 located at the top of the outer shell 12.

Inner shell 11 serves as a receptacle to be filled with beer. It has a generally cylindrical mid-part 11A, an upwardly domed upper-part 11B, and a downwardly domed lower part 11C which form a hollow container approximating a prolate spheroid. The inner shell also has a cylindrical neck part 11D standing up from the domed upper part 11B and surrounding an upper-part of the spear structure 13.

Inner shell 11 is blow moulded from PET. In cases where short shelf life is not a problem, it may be moulded in a single layer of PET. In order to improve shelf life by limiting ingress of oxygen and egress of $CO_2$, the shell 11 may be blow moulded with a multi layer or laminated construction as is known in the production of PET bottles, or alternatively, it may be lined internally with an inert coating to serve as a barrier to permeation by oxygen and $CO_2$ or a barrier coating may be sprayed on and may be such that it can be washed to allow recycling of the PET material of the inner shell. Suitable barrier coatings for this purpose are disclosed in International Patent Application PCT/US95/01545 of PPG Industries Inc., published Oct. 12, 1995, under No. WO 95/26997, the disclosure of which is hereby incorporated by reference herein.

Spear structure 13 is formed of moulded PET components and it is fixed into the upper end of the inner shell 11 by heat swaging the neck part 11D of the inner shell onto upper part of the spear structure so that the inner shell 11 and spear structure 13 form a unitary structure consisting essentially of PET, but optionally with a barrier coating which can be washed off before recycling of the PET material.

Outer shell 12 is formed of components, both moulded of high density polyethylene, namely an open topped tub shaped main body part 17 and an upper lid part 18 which is a press fit into the main body part. The peripheral wall of the main body part 17 is formed with two circumferential outstanding ribs 19 which aid in handling of the container with mechanical handling equipment. Indeed the outer shell or container may have the same external dimensions and features as conventional stainless steel kegs to enable the container to be generally handled and filled with the same equipment as the standard stainless steel kegs.

Inner shell 11 serves as a hollow beer container which is fitted within a hollow enclosure 21 formed by the tub shaped main body part 17 and lid part 18 of the outer shell 12. The cylindrical mid-part 11A of the inner shell is a sliding fit within the tub shaped main body part 17 of the outer shell. The lower end of the outer shell is shaped to form an upwardly dished floor 22 for the enclosure 21, with a curvature to match the domed lower part 11C of the inner shell thereby to provide secure and effective bottom support for the inner shell. The lower end of the outer shell is also shaped to form a peripheral base rim 20 disposed about the floor 22 and extending below the floor to flat base surfaces 20A to provide a stable base on which the keg can be stood upright.

Upper lid part 18 is upwardly dished to receive the domed upper part 11B of the inner shell, thereby to provide firm location of the upper part of that shell. Lid part 18 has a central opening 23 through which the tubular nick 11D of the inner shell and the upper part of open structure 13 project for a short distance. Lid part 18 also has an outer peripheral flange 24 which is a press fit within the main body part 17 of the outer shell at a location below its upper end, the upper end of part 17 thus forming an upstanding peripheral skirt 24 of the outer shell 12 which extends around and protects the projecting upper part of the spear structure 13.

The upper part of spear structure 13 includes a moulded PET valve body 25 which is fitted to the upper end of dispensing tube 14 and has a central tubular spigot 26 defining the dispensing opening 16. Valve body 25 has an outer tubular barrel part 27 surrounding the spigot 26 and incorporating at its upper end an annular coupler 28 to couple the spear structure to a beer dispensing system as described below. The spear structure 13 is fixed to the inner shell 11 by heat swaging the tubular neck 11D of the shell about the upper part of the outer barrel part 27 of the spear valve body 25, an O-ring 29 being clinched between the valve body and the neck 11D to form a gas tight seal to prevent escape of gas from the inner shell when it is pressurized.

A series of circumferentially spaced annular passages 31 are formed in valve body 25 between the central spigot 26 and outer barrel part 27 and the lower ends of these passages are closed by an annular sealing ring 32 snap fitted into a circumferential recess in the lower part of valve body 25 to serve as a one way valve for flow of $CO_2$ gas downwardly into the inner shell through the passages 31. A spool valve 33 fitted with an O-ring seal 34 is located within the central spigot 26 of valve body 25 to close the dispensing opening 16 unless depressed downwardly against the internal gas pressure, Pressuring $CO_2$ is applied to the interior of the inner shell 11 through the valve passages 31 and outer valve 32 which acts as a one-way valve to hold the pressure within the container, the spool valve acting under the internal pressure to close off the dispensing opening 16. To dispense beer from the pressurised container a conventional dispenser is coupled to the upper end of the spear structure by means of the coupler 28, the dispenser incorporating a mechanically operable plunger to depress the inner valve spool 33 to allow beer to flow through the dispensing opening 16 into the dispenser.

When inner shell 11 is charged with beer and is pressurised, it is expanded firmly against the outer shell 17 so as to be firmly located and supported. When the container has been emptied of beer, the lid 18 of outer shell 12 can be readily removed to allow the inner shell 11 (and with it the spear structure 13) to be removed from the main body part 17 of the outer shell. The unpressurised inner shell 11 is a sliding fit within the outer shell and it is readily removable. The two parts of the outer shell can be directed to a recycling plant for recycling of high density polyethylene material. The inner shell 11 and spear structure 13 can be directed to a plant for recycling PET material, such plant including a wash to wash out any gas barrier coating applied to the inner shell.

The illustrated beer keg construction can be produced quite economically as a fully disposable, low cost containers Moreover, it is fully recyclable since it can be readily separated into PET and high density polyethylene components which can be fed to existing recycling facilities for those particular materials. However, the illustrated keg has been advanced by way of example only and the invention is not limited to the details of that construction. Containers according to the invention may be produced in a variety of sizes and the constructional details may vary according to the particular size of the container. For some sizes, for example, the main body part of the outer shell may be formed with circumferentially spaced reinforcing ribs projecting inwardly of the shell and providing circumferentially spaced supports for the inner shell rather than continuous support about the periphery of the inner shell. The spear construction could also be varied considerably for differing size containers. It is accordingly to be understood that the invention is no way limited to the constructional details of the illustrated beer keg and that many modifications and variations will fall within the scope of the appended claims.

What is claimed is:

1. A beer container comprising:

an inner hollow shell of blow moulded PET to hold beer;

an outer hollow shell of moulded high density polyethylene enclosing and providing side, top and bottom support for the inner shell; and a spear structure fixed to the inner shell and including a dispenser tube extending from a bottom interior region of the inner shell through to a dispensing outlet at the top of the outer shell, a valve for supply of pressurising gas into the interior of the inner shell and a beer dispenser valve at the dispensing outlet.

2. A beer container as claimed in claim 1, wherein the spear structure including the valve for supply of pressurising gas and the beer dispensing valve is constructed of PET.

3. A beer container as claimed in claim 1, wherein the inner shell has an upwardly projecting tubular neck which surrounds an upper part of the spear structure.

4. A beer container as claimed in claim 3, wherein the neck of the inner shell projects through an opening in the outer shell.

5. A beer container as claimed in claim 1, wherein the outer shell has an upstanding peripheral skirt projecting upwardly about the upper part of the spear structure.

6. A beer container as claimed in claim 1, wherein the lower part of the outer shell forms an upwardly dished floor support for the inner shell.

7. A beer container as claimed in claim 6, wherein the lower part of the inner shell is downwardly domed to match the dished floor support.

8. A beer container as claimed in claim 6, wherein the lower part of the outer shell also forms a peripheral base rim disposed about the dished floor support and extending below that floor support to provide a base on which the container can be stood upright.

9. A beer container comprising:

an inner hollow shell of blow moulded PET to hold beer;

an outer hollow shell of moulded high density polyethylene enclosing and supporting the inner shell; and a spear structure constructed of PET and fixed to the inner shell, the spear structure including a dispenser tube extending from a bottom interior region of the inner shell through to a dispensing outlet at the top of the outer shell.

10. A beer container as claimed in claim 9, wherein the outer shell is formed in separable pieces which can be separated from the inner shell for recycling of the high density polyethylene of the outer shell separately from the PET material of the inner shell and the spear.

11. A beer container comprising:

an inner hollow shell of blow moulded PET to hold beer;

an outer hollow shell of moulded high density polyethylene enclosing and supporting the inner shell; and a spear structure constructed of PET including a dispenser tube extending from a bottom interior region of the inner shell through to a dispensing outlet at the top of the outer shell, wherein the outer shell is formed in separable pieces which can be separated from the inner shell for recycling of the high density polyethylene of the outer shell separately from the PET material of the inner shell and the spear, the outer shell comprising a generally open topped tub-shaped body fitted with a releasable lid.

12. A beer container as claimed in claim 11, wherein the lid is press fit on the tub shaped body.

13. A beer container as claimed in claim 11, wherein the inner shell is a sliding fit within the tub shaped main body of the outer shell, whereby it can be slid from the outer shell main body when the lid is removed.

14. A beer container as claimed in claim 13, wherein the inner shell has a cylindrical peripheral surface with which the outer shell is a neat sliding fit.

* * * * *